United States Patent [19]

Kawabata et al.

[11] 4,401,740

[45] Aug. 30, 1983

[54] ELECTROGRAPHIC DEVELOPMENT PROCESS

[75] Inventors: Toshiyasu Kawabata, Sunto; Hachiro Tosaka, Susono; Toshiki Nanya, Numazu, all of Japan

[73] Assignee: Ricoh Company, Ltd., Tokyo, Japan

[21] Appl. No.: 337,213

[22] Filed: Jan. 5, 1982

[30] Foreign Application Priority Data

Jan. 16, 1981 [JP] Japan ..... 56-5418

[51] Int. Cl.[3] ..... G03G 13/08; G03G 13/09

[52] U.S. Cl. ..... 430/102; 430/106.6; 430/109; 430/122

[58] Field of Search ..... 430/102, 106.6, 109, 430/122

[56] References Cited

U.S. PATENT DOCUMENTS

| | | | |
|---|---|---|---|
| 3,645,770 | 2/1972 | Flint | 430/106.6 X |
| 4,142,981 | 3/1979 | Bean et al. | 430/109 |
| 4,165,393 | 8/1979 | Suzuki et al. | 430/122 |
| 4,239,845 | 12/1980 | Tanaka et al. | 430/106.6 X |
| 4,331,757 | 5/1982 | Tanaka et al. | 430/122 |

*Primary Examiner*—Roland E. Martin, Jr.

*Attorney, Agent, or Firm*—Flynn, Thiel, Boutell & Tanis

[57] ABSTRACT

An electrographic development process wherein an electrically charged developer comprising electrically conductive particles with a volume resistivity of $10^9$ Ωcm or less and toner particles with a volume resistivity of $10^{12}$ Ωcm or more, with the mixing ratio of the respective particles being from 1:99 to 40:60, is brought into contact, or proximity, with a latent electrostatic image with a polarity opposite to that of the electrically charged developer, and the latent electrostatic image is developed to a visible image by the developer, through the steps of supplying the developer to a developer doner member; forming a developer layer thereon with a thickness ranging from 150 μm to 300 μm; subjecting the developer to charge injection to a potential ranging from −150 V to −500 V; and supplying the developer to a latent electrostatic image bearing member for development of the latent electrostatic image thereon.

10 Claims, 3 Drawing Figures

ELECTROGRAPHIC DEVELOPMENT PROCESS

BACKGROUND OF THE INVENTION

The present invention relates to an electrographic development process, and more particularly to an electrophotographic development process employing a developer comprising electrically conductive particles and toner particles with high resistivity (hereinafter referred to as high resistivity toner particles).

Conventionally, in the field of electrostatic recording, a development process is known wherein a developer is electrically charged to a certain polarity and is brought into contact, or proximity, with an image pattern of electric charges with a polarity opposite to the polarity of the developer, whereby the electrically charged image pattern is developed to a visible image by the developer being electrically attracted thereto.

It is required that the developer for use in this process meet two contradictory conditions, i.e., it must both allow easy charge injection and provide high charge retention. In order to meet those requirements, a development process as partly shown schematically in FIG. 1 has been proposed, in which a developer 2 is magnetically or electrically attracted to a donor roller 1 and is held thereon. Electric charges with a predetermined polarity are injected into the developer 2 held on the donor roller 1, so that the developer 2 is electrically charged to that predetermined polarity. The developer 2 is then brought into contact with a latent electrostatic image with a polarity opposite to that of the developer 2, formed on a latent electrostatic image bearing member (not shown), whereby the latent electrostatic image is developed when the developer 2 is electrically attracted thereto.

Two variations of this proposed development process are known. In the first type, there are disposed separately a blade member for regulating the thickness of the developer on the donor roller 1, and an electrode for injecting electric charges into the developer, while in the second type, a doctor blade, which serves as the blade member and as the electrode, is used. In the development process shown in FIG. 1, a doctor blade 3 serves for regulating the thickness of the developer 2 on the donor roller 1 to a predetermined thickness and, at the same time, for injecting electric charges into the developer 2 from a power source 4.

In this process, it is known that the speed of charge injection from the doctor blade 3 to the developer 2, which is defined as the number of electrons which flow from the doctor blade to the developer per unit time, and the quantity of electric charges held in the developer 2, increase as the pressure applied by the doctor blade 3 to the developer 2 and the quantity of the developer 2 on the donor roller 1 increase.

In the present invention, it is necessary that the developer allow electrons to flow easily thereinto, yet still trap electrons effectively.

In order to increase the quantity of charges trapped by the developer from the viewpoint of the above-mentioned necessity, the developer must have high electric resistivity, and a high voltage must be applied to the developer through the doctor blade. However, if the voltage applied is high, there is a risk that the developer layer formed on the donor roller 1 will be destroyed by excess charging, or spark discharging may take place in the neighboring parts, resulting, among other problems, in the so-called blank "halos" in the solid portion of the developed images.

Under such circumstances, in order to obtain electric charges sufficient for development in this process, conventionally the electric resistivity of the developer mass as a whole is decreased by applying pressure to the developer through a blade and thickly packing the developer layer. The aim of this decreasing of the electric resistivity of the developer is to achieve easy and stable charge injection into the developer. However, it is extremely difficult in practice to attain stable charge injection by such mechanical adjustment of the blade. As a matter of fact, that method is far from being of practical use.

SUMMARY OF THE INVENTION

It is therefore an object of the present invention to provide an electrographic development process capable of providing clear images free from halos, without the necessity for high voltage application to the developer employed, and from which the conventional shortcomings have been eliminated.

According to the present invention, the above-mentioned object is attained by an electrographic development process wherein a developer comprising electrically conductive particles with a volume resistivity of $10^9$ Ωcm or less and high resistivity toner particles with a volume resistivity of $10^{12}$ Ωcm or more is supplied to a donor member to form a layer having a thickness ranging from 150 μm to 300 μm, at which donor member electric charges are injected from an external blade member into the developer layer to a potential ranging from −150 V to −500 V, and thereafter the electrically charged developer is brought into contact, or proximity, with electric-charge image patterns having a polarity opposite to that of the developer, whereby the electric-charge patterns are developed to visible images. In the developer for use in the present invention, the average particle size of the high resistivity toner particles is in the range of 5 μm to 20 μm, and the average particle size of the electrically conductive particles is in the range of 1/5 to 4/5 the average particle size of the high resistivity toner particles.

Furthermore, the charge injection efficiency of the developer for use in the present invention is so high that delicate positional adjustment of the blade for charge injection and application of conventionally high voltage to the blade are unnecessary. Therefore, the conventional risk of spark discharging during charge injection can be completely eliminated.

DETAILED DESCRIPTION OF THE PREFERRED EMBODIMENTS

In an electrographic development process according to the present invention, a developer comprising electrically conductive particles with an electric volume resistivity of $10^9$ Ωcm or less, and high resistivity toner particles with an electric volume resistivity of $10^{12}$ Ωcm or more, is employed. The mixing ratio by weight of the electrically conductive particles to the high resistivity toner particles is from 1:99 to 40:60. The average particle size of the high resistivity toner particles is in the range of 5 μm to 20 μm, while the average particle size of the electrically conductive particles is in the range of 1/5 to 4/5 the average particle size of the high resistivity toner particles. Throughout the description of this invention, "average particle size" means volume mean diameter. When the average particle size of the electrically conductive particles is smaller than 1/5 the average particle size of the high resistivity toner particles, the charge injection and charge retention of the developer are significantly degraded, while when the former is greater than 4/5 the latter, the charge retention is markedly degraded.

Figure 1:
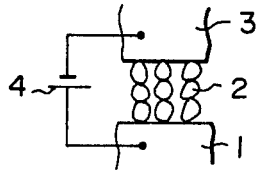
FIG. 1 PRIOR ART
FIG. 1 is a schematic illustration of a charge injection process for a developer in a prior-art development apparatus.
Figure 2:
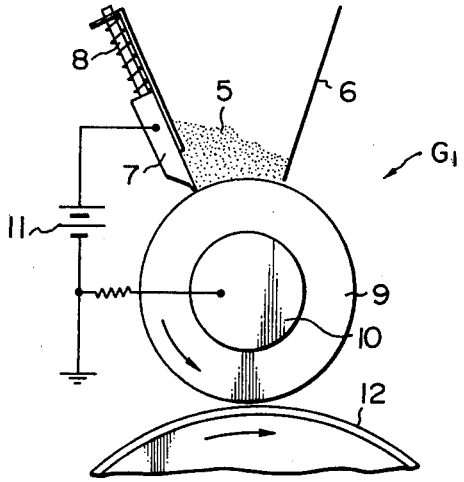
FIG. 2 is a schematic partial illustration of a development apparatus that can be employed in the present invention.
Figure 3:
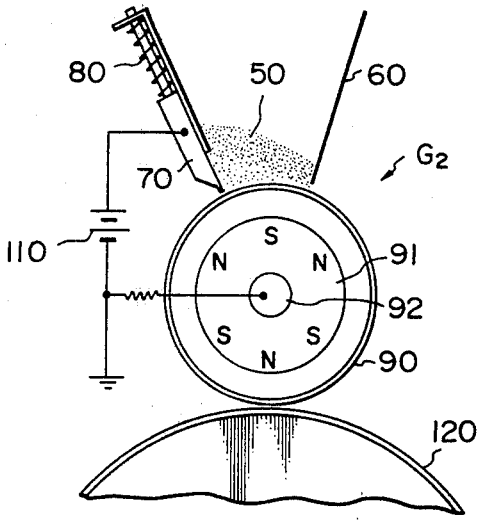
FIG. 3 is a schematic partial illustration of another development apparatus that can be employed in the present invention.

The developer is layered to a thickness in the range of 150 μm to 300 μm on a donor member made of, for instance, a silicone resin material having a thickness of less than 5 μm coated on an aluminum drum when the developer is non-magnetic, or on a non-magnetic sleeve with inner magnets which can be rotated relative to each other when the developer employed is magnetic, and is subjected to charge injection to a potential ranging from −150 V to −500 V by a development apparatus as shown in FIG. 2 or FIG. 3.

The electrically charged developer is then brought into contact, or proximity, with electrostatic latent images, the aforementioned charge patterns, which are borne by a conventional selenium drum for use in electrophotography, whereby the charge patterns are developed to visible images. The developed images are transferred from the selenium drum to plain paper under application of corona charges thereto. The visible images transferred to the plain paper are thermally fixed, whereby clear copy images free from halos in the solid image areas are obtained.

Examples of embodiments of a development process according to the present invention will now be explained.

EXAMPLE 1

A mixture of 100 parts by weight of Piccolastic D-125 (polystyrene made by Esso Standard Oil Co., Ltd.) and 10 parts by weight of carbon black was kneaded under application of heat thereto by heat rollers. After cooling the mixture was ground to powder and the powder was classified, so that high resistivity toner particles with an average particle size of 20 μm and with an electric volume resistivity of $4\times10^{14}$ Ωcm was obtained.

100 parts by weight of the thus prepared toner particles were mixed with 25 parts by weight of $Fe_3O_4$ particles with an average particle size of 8 μm and with an electric volume resistivity of $3\times10^7$ Ωcm, whereby a developer 5 (refer to FIG. 2) for use in the present invention was prepared.

The developer 5 was subjected to charge injection by a development apparatus $G_1$ as shown in FIG. 2. In the figure, reference numeral 6 represents a hopper in which the developer 5 is held; reference numeral 7, a doctor blade which serves as a member for regulating the thickness of a developer layer formed on a donor roller 9 (made of aluminum whose outer surface is covered with a silicone resin film with a thickness of 3 μm) as well as an electrode for charge injection to the developer 5; reference numeral 8, a pressure application spring member which urges the doctor blade 7 towards the surface of the donor roller 9; reference numeral 10, an electrically conductive shaft for supporting the donor roller 9; reference numeral 11, a bias power source for applying voltage across the doctor blade 7 and the shaft 10; and reference numeral 12, a photoconductor drum made of selenium.

In FIG. 2, the gap between the doctor blade 7 and the surface of the donor roller 9 was set at 200 μm, and the donor roller 9 was rotated in the direction of the arrow, whereby a developer layer with a thickness of approximately 200 μm was formed on the donor roller 9, under application of a potential of −300 V across the layer of the developer 5.

A latent electrostatic image with a positive polarity was formed on the selenium photoconductor drum 12 by a conventional electrographic procedure. The latent electrostatic image was then developed with the developer 5 by the development apparatus $G_1$ as shown in FIG. 2. The developed image was transferred to plain paper under application of positive corona charges thereto and was then fixed to the plain paper under application of heat. As a result, a clear copy image free from halos was obtained.

EXAMPLE 2

A mixture of 100 parts by weight of Piccolastic D-125 (polystyrene made by Esso Standard Oil Co., Ltd.) and 40 parts by weight of magnetite was kneaded under application of heat thereto by heat rollers. After cooling the mixture, it was ground to powder and the powder was classified, so that high resistivity toner particles with an average particle size of 10 μm and with an electric volume resistivity of $8\times10^{14}$ Ωcm was obtained.

90 parts by weight of the thus prepared electrically insulating particles were mixed with 10 parts by weight of electrically conductive particles comprising polyethylene resin and carbon black, with an average particle size of 6 μm and with an electric resistivity of $2\times10^5$ Ωcm, whereby a magnetic developer 50 (refer to FIG. 3) for use in the present invention was prepared.

The developer 50 was subjected to charge injection by a development apparatus $G_2$ as shown in FIG. 3. In the figure, reference numeral 60 represents a hopper in which the developer 50 is held; reference numeral 70, a doctor blade which serves as a member for regulating the thickness of a developer layer formed on a donor sleeve 90 (made of a non-magnetic material) as well as an electrode for charge injection to the developer 50; reference numeral 80, a pressure application spring member which urges the doctor blade 70 towards the surface of the donor sleeve 90; reference numeral 91, a magnet; reference numeral 92, an electrically conductive shaft; reference numeral 110, a bias power source for applying voltage across the doctor blade 70 and the shaft 92; and reference numeral 120, a photoconductor drum made of selenium.

In FIG. 3, the gap between the doctor blade 70 and the the donor sleeve 90 was set at 200 μm, and the donor sleeve 90 and the magnet 91 were rotated relative to each other (either or both can in practice be rotated), whereby a developer layer with a thickness of approximately 200 μm was formed on the donor sleeve 90, under application of a potential of −300 V across the layer of the developer 50.

A latent electrostatic image with a positive polarity was formed on the selenium photoconductor drum 120 by a conventional electrographic procedure. The latent electrostatic image was then developed with the developer 50 by the development apparatus $G_2$ as shown in FIG. 3. The developed image was transferred to plain paper under application of positive corona charges thereto and was then fixed to the plain paper under application of heat. As a result, a clear copy image free from halos was obtained.

What is claimed is:

1. An electrographic development process comprising the steps of:

forming a layer of a developer composition which layer has a thickness in the range of from 150 μm to 300 μm, said developer comprising a blend of (a) high resistivity toner particles having a volume resistivity of at least $10^{12}$ Ωcm and an average particle size in the range of from 5 μm to 20 μm, and (b) electrically conductive particles having a volume resistivity of $10^9$ Ωcm or less and an average particle size in the range of from 1/5 to 4/5 the average particle size of said high resistivity toner particles (a), the mixing ratio by weight of said electrically conductive particles (b) to said high resistivity toner particles (a) being in the range of 1:99 to 40:60;

subjecting said layer of said developer composition to charge injection to a potential in the range of from 150 V to 500 V; and then moving said layer of said charged developer composition into contact with or in close proximity to a latent electrostatic image having a polarity opposite to that of said charged developer composition, thereby developing said latent electrostatic image and forming a visible image as a result of the electric attraction between said developer composition and said latent electrostatic image.

2. An electrographic development process as claimed in claim 1, wherein said electrically conductive particles are selected from the group consisting of $Fe_3O_4$ particles and particles of a mixture of polyethylene resin and carbon black.

3. An electrographic development process comprising the steps of:

forming, on a donor member, a layer of a developer composition which layer has a substantially uniform thickness in the range of from 150 μm to 300 μm, said developer composition consisting essentially of a dry blend prepared by comingling (a) first high resistivity particles having a volume resistivity of at least $10^{12}$ Ωcm and an average particle size in the range of from 5 μm to 20 μm, with (b) second electrically conductive particles having a volume resistivity of $10^9$ Ωcm or less and an average particle size in the range of from 1/5 to 4/5 the average particle size of said first high resistivity particles, at least one of said first high resistivity particles and said second electrically conductive particles containing coloring material, the mixing ratio by weight of said second electrically conductive particles to said first high resistivity particles being in the range of 1:99 to 40:60;

injecting electric charges of a predetermined polarity into said layer of said developer composition to charge said developer composition to a potential in the range of from 150 V to 500 V; and then moving said layer of said charged developer composition into contact with or in close proximity to a member bearing a latent electrostatic image of a polarity opposite to that of said charged developer composition, thereby developing said latent electrostatic image to form a visible image.

4. An electrographic development process as claimed in claim 3, wherein said toner particles comprise a magnetic material, and said donor member comprises a non-magnetic sleeve and magnets disposed within said non-magnetic sleeve, which sleeve and which magnets can be rotated relative to each other.

5. A process as claimed in claim 3, wherein said first high resistivity particles contain a magnetic material and said second electrically conductive particles contain said coloring material, and said donor member comprises a non-magnetic cylindrical sleeve, magnets disposed within said sleeve, said sleeve and said magnets being adapted for rotation relative to each other.

6. A process as claimed in claim 3, wherein said first high resistivity particles consist essentially of a thermoplastic resin and said coloring material, and said second electrically conductive particles contain a magnetic material.

7. A process as claimed in claim 3, wherein said first high resistivity particles consist essentially of polystyrene and carbon black, and said second electrically conductive particles consist essentially of $Fe_3O_4$.

8. A process as claimed in claim 3, wherein said first high resistivity particles consist essentially of a thermoplastic resin and magnetic material, and said second electrically conductive particles consist essentially of an electrically conductive coloring material and a thermoplastic resin.

9. A process as claimed in claim 3, wherein said first high resistivity particles consist essentially of polystyrene and magnetite, and said second electrically conductive particles consist essentially of polyethylene and carbon black.

10. An electrographic development process comprising the steps of:

rotating a developer donor roll beneath a hopper containing a supply of a powdery developer composition which is in contact with a portion of the surface of said donor roll, and thence beneath a doctor blade which defines one side of said hopper, said powdery developer composition consisting essentially of a blend of first high resistivity particles having a volume resistivity of at least $10^{12}$ Ωcm and an average particle size in the range of from 5 to 20 μm, and second electrically conductive particles having a volume resistivity of from $10^9$ Ωcm or less and an average particle size in the range of from 1/5 to 4/5 of the average particle size of said first high resistivity particles, one of said first particles and said second particles containing a coloring material, the weight ratio of said second electrically conductive particles to said first high resistivity particles being in the range of 1:99 to 40:60, said doctor blade being disposed slightly above the surface of said donor roll such that a layer of said developer composition having a uniform thickness in the range of from 150 to 300 μm is formed of said donor roll, and simultaneously applying a bias voltage between said donor roll and said doctor blade and thereby injecting electric charges into said developer composition layer so that said developer composition layer is charged to a voltage in the range of −150 to −500 V; then further rotating said donor roll and moving it into contact with or in close proximity to a rotating electrophotographic drum bearing a latent electrostatic image having a polarity opposite to that of said charged developer composition layer so that said latent electrostatic image is developed to a visible image.

* * * * *